US009909845B2

(12) United States Patent
Lee et al.

(10) Patent No.: US 9,909,845 B2
(45) Date of Patent: Mar. 6, 2018

(54) BLAST ATTENUATOR

(71) Applicant: ARMOURWORKS INTERNATIONAL LTD, Gloucester (GB)

(72) Inventors: Yuk L Lee, Glouchester (GB); Ian Richards, Glouchestershire (GB)

(73) Assignee: Armorworks Holdings, Inc., Chandler, AZ (US)

( * ) Notice: Subject to any disclaimer, the term of this patent is extended or adjusted under 35 U.S.C. 154(b) by 311 days.

(21) Appl. No.: 15/103,238

(22) PCT Filed: May 9, 2014

(86) PCT No.: PCT/GB2014/051434
§ 371 (c)(1),
(2) Date: Jun. 9, 2016

(87) PCT Pub. No.: WO2014/188159
PCT Pub. Date: Nov. 27, 2014

(65) Prior Publication Data

US 2016/0313094 A1 Oct. 27, 2016

(30) Foreign Application Priority Data

May 21, 2013 (GB) ..... 1309134.3

(51) Int. Cl.
*F41H 7/04* (2006.01)
*F42D 5/045* (2006.01)

(52) U.S. Cl.
CPC ..... *F41H 7/042* (2013.01); *F41H 7/046* (2013.01); *F42D 5/045* (2013.01)

(58) Field of Classification Search
CPC ..... F42D 5/045; F41H 7/04; F41H 7/046
USPC ..... 89/36.02, 903; 86/50; 102/402
See application file for complete search history.

(56) References Cited

U.S. PATENT DOCUMENTS

| | | | | |
|---|---|---|---|---|
| 5,791,597 A * | 8/1998 | Knoll | B60N 2/4242 244/121 |
| 6,179,380 B1 * | 1/2001 | Hoffman | B60N 2/4242 297/216.1 |
| 6,189,969 B1 * | 2/2001 | McLaughlin | B60N 2/4415 297/216.1 |
| 8,371,647 B2 * | 2/2013 | Ripley | F41H 7/046 280/740 |
| 2011/0126698 A1 | 6/2011 | Ripley | |

FOREIGN PATENT DOCUMENTS

| | | |
|---|---|---|
| AU | 2009200914 A1 | 9/2009 |
| EP | 2264395 A2 | 12/2010 |
| WO | WO2004038320 A1 | 5/2004 |
| WO | WO2009099621 A1 | 8/2009 |
| WO | WO2013068380 A1 | 5/2013 |

* cited by examiner

*Primary Examiner* — Jonathan C Weber
(74) *Attorney, Agent, or Firm* — James L Farmer

(57) ABSTRACT

Methods and apparatus are provided for a blast attenuator having a container with an outer wall that defines a cavity in which a particulate media is disposed, and a stirring element disposed in and moveable relative to the container. At least a portion of the stirring element extends into the particulate media, wherein, in use, the particulate media provides resistance against movement of the stirring element relative to particulate media so as to attenuate the energy of a blast.

30 Claims, 6 Drawing Sheets

BLAST ATTENUATOR

TECHNICAL FIELD AND BACKGROUND

The invention relates to a blast attenuator and particularly, but not exclusively, to a blast attenuator for a seat, blast floor or V-shaped hull of a vehicle used in a combat zone.

In a combat zone, vehicles such as tanks, personnel carriers including armored personnel carriers, trucks, and the like, may be targets of explosive devices, such as land mines, rocket propelled grenades and other improvised explosive devices (IEDs). Such explosive devices are typically triggered automatically by mobile trigger or the weight of the vehicle passing over the device and can cause catastrophic damage to both the vehicle and its occupants.

It is desirable to protect combat vehicles and their occupants from such explosive devices. For example, vehicles may be equipped with armor plating (for example, an armor-plated V-hull) to prevent blasts from penetrating the internal space of the vehicle. Nevertheless, while armor can prevent injury from shrapnel, occupants may be injured by the initial impact of the blast which violently displaces the vehicle and the subsequent "slam-down" as the vehicle returns to the ground.

It is known to provide combat vehicles with devices, such as blast attenuators, that absorb the impact of a blast and the subsequent slam-down in order to reduce the forces experienced by the occupants of the vehicle. For example, the seats of the vehicle may be connected to the body of the vehicle via a blast attenuator which allows the seat to move relative to the vehicle in the event of a blast, thus isolating the occupant from the vehicle.

A deformable link may be disposed between the seat and the vehicle to act as a blast attenuator. The deformable link is connected at one end to the seat and at the other end to a surface of the vehicle such as the floor or a wall. In the event of a blast, the link may deform so as to reduce the distance between its ends, thereby absorbing some of the impact of the blast. Similar functionality may be obtained with gas struts or oil-filled oleo struts.

However, such blast attenuators normally only provide attenuation of movement in a single direction (typically in the vertical direction). Moreover, the arresting load (or attenuating force) provided by such blast attenuators is not constant and varies depending on the applied blast load magnitude and the speed and acceleration of compression.

It is therefore desirable to provide an improved blast attenuator which overcomes some or all of the problems displayed by conventional blast attenuators.

SUMMARY OF THE INVENTION

In accordance with an aspect of the invention there is provided a blast attenuator comprising: a container having an outer wall, the outer wall defining a cavity in which a particulate media is disposed; and a stirring element disposed in the container and movable relative to the container, at least a portion of the stirring element extending into the particulate media. In use, the particulate media provides resistance against movement of the stirring element relative to particulate media so as to attenuate the energy of a blast.

The stirring element may be allowed to move freely with respect to the container. Specifically, the stirring element can be displaced axially (i.e. vertically) or horizontally (laterally and longitudinally) relative to the container. Further, the stirring element may tilt or rotate relative to the container. All of these modes of movement cause the stirring element to displace the particulate media and thus the particulate media provides resistance against the movement of the stirring element. Although the stirring element may be allowed to move freely with respect to the container, only one mode of movement may be used under certain conditions. For example, the stirring element may only move axially at certain times, thus functioning as a damper. Alternatively, the stirring element may be allowed to move only in the axial direction to provide this functionality.

The resistance and motion attenuation offered by the blast attenuator is determined primarily by inter-particulate friction. The attenuating force is thus constant regardless of the applied blast load magnitude, loading speed, acceleration of the vehicle, temperature and so on.

The particulate media may comprise granules, fibres fibers and/or flakes of a suitable material.

The blast attenuator may further comprise a plurality of stationary elements which project into the cavity and which are fixed relative to the container.

The stationary elements modify the friction and flow properties of the particulate media in the cavity. Specifically, the stationary elements inhibit movement of the particulate media at the outer wall. Accordingly, the stationary elements create a boundary layer condition at the outer wall where the velocity of the particulate media is substantially zero. As a result of the relative smoothness of the outer wall, particulate-wall friction is smaller than inter-particulate friction. Therefore, the creation of this boundary layer condition using the stationary elements maximizes the friction capacity of the blast attenuator.

The stationary elements may be arranged around the perimeter of the shaft to form one or more rows.

The stationary elements may comprise plates.

The stationary elements may have a profiled distal edge. For example, the distal edge may be castellated or crenellated. Alternatively, the stationary elements may be rods which project into the cavity and have a rounded end. These forms of stationary elements impose a partial boundary layer condition which increases friction, while maintaining flow of the particulate media.

The stationary elements may be a series of splines which are arranged around the circumference of the inner surface of the outer wall, and which each run along the length of the outer wall of the container. Such splines may run along the full length of the outer wall or may be provided in discontinuous sections which are aligned and/or offset from the stirring elements.

The stirring element may comprise a shaft and a plurality of paddles which extend radially from the shaft into the particulate media.

The paddles may be aligned with the longitudinal axis of the shaft and extend radially from the shaft. The shaft may taper at its end to form a conical point.

The paddles may be spaced equiangularly about the shaft.

Each paddle may be diametrically opposed of another paddle. This may ensure that the resistance against the movement of the stirring element is balanced.

The paddles may be arranged around the perimeter of the shaft to form one or more rows.

The or each row of paddles may be aligned with the or each row of stationary elements.

Alternatively, the or each row of paddles may be offset from the or each row of stationary elements. Therefore, some or all of the rows of paddles may be disposed between adjacent rows of stationary elements, and/or vice versa.

The stirring element may comprise a helical stirrer or a formed wire stirrer.

The stirring element may comprise a plurality of stirrers which are spaced from one another in an axial direction.

The or each stirrer may be aligned with the or each row of stationary elements.

Alternatively, the or each stirrer may be offset from the or each row of stationary elements. Therefore, some or all of the stirrers may be disposed between adjacent rows of stationary elements, and/or vice versa.

The blast attenuator may further comprise a support mechanism which movably couples the stirring element to the container.

The support mechanism may comprise a plurality of spokes which connect the stirring element to the container and which are deformable along their length to allow the stirring element to move relative to the container.

The spokes may be coupled to the stirring element via a collar which connects to the shaft of the stirring element.

The spokes may be flexible strips which are arranged such that deformation along the length of the strip is in the radial plane. In other words, the width of the strip is oriented axially.

The spokes may be C-shaped (single curve) or S-shaped (double curve). An S-shaped spoke has an increased length and thus may be more flexible in respect of in-plane and out-of-plane deflections.

The spokes may be sufficiently stiff to absorb static in-service loads (i.e. when there is no blast), but may be sufficiently flexible to yield elastically and/or plastically in order to permit large movements of the stirring element relative to the container during the movement of the stirring element relative to the container.

The blast attenuator may comprise a first support mechanism and a second support mechanism, the first and second support mechanisms being provided at different positions along the axial length of the stirring element. The first and second support mechanisms produce a torque couple when there is any static tilting and thus may provide more efficient resistance to static in-service tilting tendencies while the passenger is seated.

The blast attenuator may further comprise an elastic, flexible membrane which encloses the cavity and retains the particulate media. The flexible membrane may be used to reset the blast attenuator in time for the slam-down stroke of a blast. The flexible membrane may be placed under tension when the particulate media impacts the membrane, and, owing to its elasticity, rebounds, driving the particulate media downwards towards the base of the container.

The stirring element may pass through the flexible membrane.

The stirring element may be rotatably coupled to the container. For example, the stirring element may be rotatably coupled to the container using a bearing which is suitable for use with the particulate media.

The blast attenuator may comprise a plurality of stirring elements which are disposed in the container and which are configured to attenuate the energy of a blast along a plurality of different axes which are orthogonal to one another. The container and thus particulate media are therefore common to the stirring elements.

The blast attenuator may comprise three stirring elements.

The or each stirring element may be associated with a mechanism for converting linear motion into rotary motion of the stirring element.

The mechanism may be a rack and pinion, the pinion being coupled to the stirring element to rotate the stirring element in response to linear motion of the rack relative to the pinion.

The pinion may be coupled to the stirring element via a ratchet mechanism. The ratchet mechanism may have an engaged configuration which prevents relative motion between the stirring element and the pinion and a disengaged configuration which allows relative motion between the stirring element and the pinion.

The ratchet mechanism may be configured so as to be in the engaged configuration when the rack moves downwards relative to the pinion and to be in the disengaged configuration when the rack moves upwards relative to the pinion.

During both the initial upwards stroke of the blast and the subsequent slam-down stroke of the blast, the rack may move downwards relative to the pinion. Accordingly, the ratchet mechanism is in the engaged configuration and thus attenuates the blast by converting rotation of the pinion into rotation of the stirring element against the resistance of the particulate media.

On the other hand, the rack moves upwards relative to the pinion just prior to the slam-down stroke as the rack rebounds upwards. Accordingly, the ratchet mechanism is in the disengaged configuration and thus allows the pinion to rotate without rotating the stirring element. Therefore, the pinion can move relative to the rack without any resistance from the particulate media. The position of the rack and pinion can thus be reset (or returned towards the reset position) prior to the slam-down stroke.

In accordance with another aspect of the invention there is provided a blast attenuation system comprising a plurality of blast attenuators as described above.

In accordance with another aspect of the invention there is provided a vehicle seat comprising a blast attenuator or a blast attenuation system as described above.

In accordance with another aspect of the invention there is provided a vehicle comprising a blast attenuator, a blast attenuation system or a vehicle seat as described above.

BRIEF DESCRIPTION OF THE DRAWINGS

For a better understanding of the present disclosure, and to show more clearly how it may be carried into effect, reference will now be made, by way of example, to the accompanying drawings, in which.

DESCRIPTION OF THE EMBODIMENTS

Figure 1:
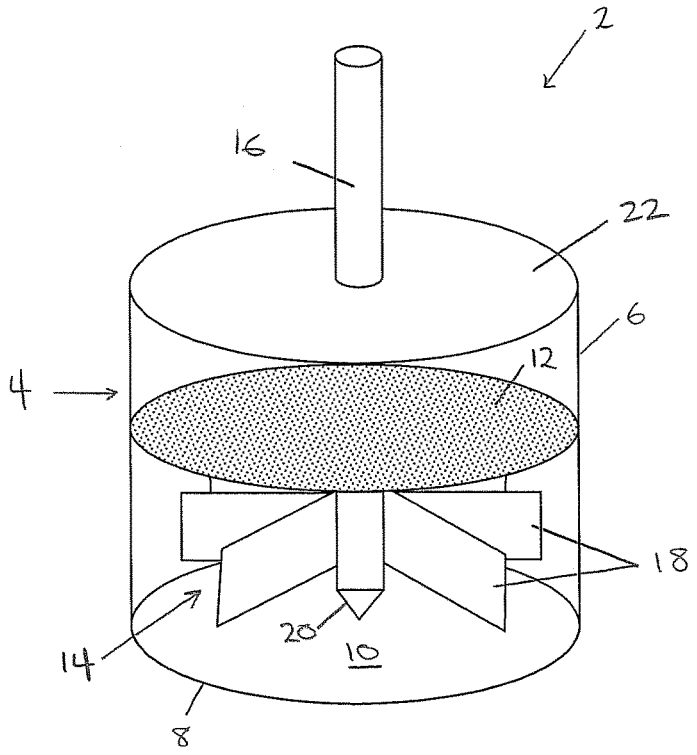
FIG. 1 is a perspective view of a blast attenuator according to an embodiment of the invention.

FIG. 1 shows a blast attenuator 2 according to an embodiment of the invention.

The blast attenuator 2 comprises a container 4 having a cylindrical outer wall 6 and a base 8.

The container 4 defines a cavity 10 bounded by the outer wall 6 and the base 8. The cavity 10 is at least partially filled with a particulate media 12. The particulate media 12 may comprise granules, fibers and/or flakes of a suitable material, and will be described in more detail below. For clarity, only the top surface of the particulate media 12 is shown, however, it will be appreciated that the particulate media 12 fills the cavity 10 between the base 8 and the top surface shown.

The blast attenuator 2 further comprises a stirring element 14 which is received in the cavity 10 of the container 4, but is freely movable relative to the container 4. The stirring element 14 comprises a shaft 16 and a plurality of paddles 18 which extend outwardly from the shaft 16. As shown, the shaft 16 tapers at its end to form a conical point 20.

As described above, the stirring element 14 is received in the cavity of the container such that the paddles 18 are surrounded by the particulate media 12.

Figure 2:
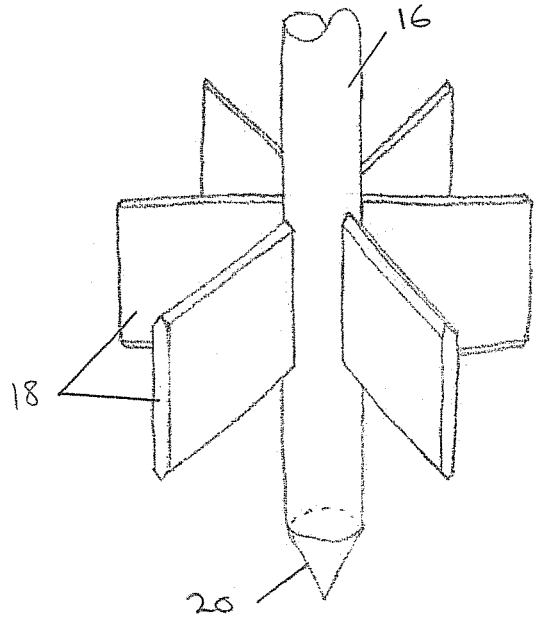
FIG. 2 is an enlarged perspective view of a stirring element of the blast attenuator.

As shown in more detail in FIG. 2, the paddles 18 of the stirring element 14 are flat plates which are connected at one end to the shaft 16 and extend from the shaft to toward the outer wall 6 of the container 4. The paddles 18 are aligned with the longitudinal axis of the shaft 16.

The paddles 18 are equiangularly spaced about the circumference of the shaft 16. Further, an even number of paddles 18 (six are shown, but other numbers may be used) are provided such that each paddle 18 is diametrically opposed from another of the paddles 18.

The paddles 18 are aligned with one another in the axial direction so as to form a row of paddles 18 spaced around the circumference of the shaft 16.

Figure 3:
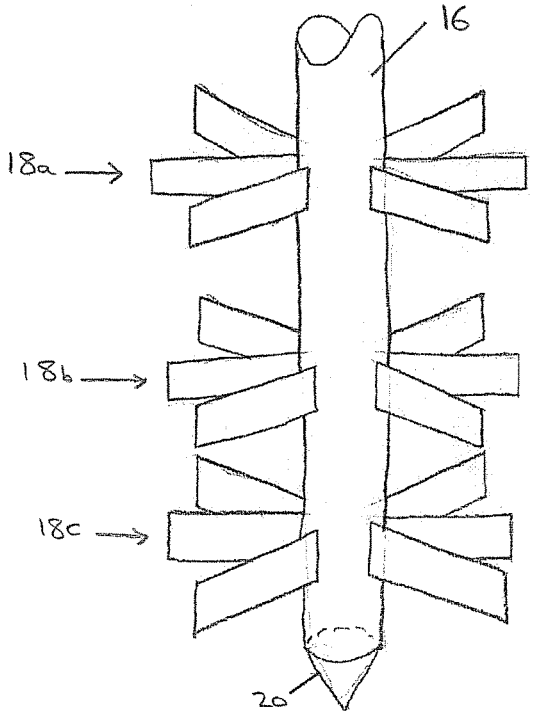
FIG. 3 is a perspective view of an alternative stirring element which may be used in the blast attenuator.

As shown in FIG. 3, the stirring element 14 may comprise a plurality of rows of paddles 18 which are spaced along the length of the shaft 16. Although three rows of paddles 18 are shown, labeled 18*a*, 18*b* and 18*c*, any number of rows may be used.

The cavity 10 of the container 4 is enclosed by a flexible membrane 22 which is constructed from rubber or another flexible and resilient material which has elastic properties. The flexible membrane 22 opposes the base 8 of the container 4 and is coupled to the outer wall 6. The flexible membrane 22 has an opening at its centre which allows the shaft 16 to pass therethrough. The opening in the flexible membrane 22 may have a diameter which is slightly smaller than the diameter of the shaft 16. Accordingly, the flexible membrane 22 must stretch to fit over the shaft 16, thereby forming a seal between the flexible membrane 22 and the shaft 16.

In use, the container 4 may be connected to a first component, such as the body or chassis (i.e. at the floor or a side wall) of a vehicle, and the stirring element 14 may be connected to a second component, such as a seat of the vehicle.

As described above, the stirring element 14 is freely movable relative to the container 4. The movement of the stirring element 14 relative to the container 4 moves the particulate media 12 thereby generating friction between the particles themselves (inter-particulate friction), and between the particles and the outer wall 6 of the container 4 (particulate-wall friction). The particulate media 12 therefore provides resistance against the movement of the stirring element 14 relative to the container 4. In the event of an impact (i.e. resulting from an explosion or blast) the resistance provided by the particulate media 12 acts as an attenuating force and absorbs energy from the impact.

The blast attenuator 2 is able to absorb energy from impacts via three primary modes of operation.

Specifically, the stirring element 14 may move axially relative to the container 4. This plunging movement causes the particulate media 12 to be displaced by the shaft 16 and the paddles 18 of the stirring element. Assuming that the blast attenuator is arranged with the shaft 16 in a vertical orientation, this mode of operation is able to absorb energy from impacts which occur primarily in the vertical plane.

The stirring element 14 may also tilt relative to the container 4. The shaft 16 and the paddles 18 of the stirring element 14 slide through the particulate media 12 and dissipate energy through friction with the particles. Tilting of the stirring element 14 relative to the container 4 is able to accommodate both lateral horizontal motion of the vehicle and longitudinal horizontal motion of the vehicle.

Finally, the stirring element 14 may rotate about the longitudinal axis of the shaft 16 (twist or spin) relative to the container 4. Rotation of the stirring element 14 relative to the container 4 causes the paddles 18 to be forced through the particulate media 12. The rotation of the stirring element 14 utilizes the greatest surface area of the paddles 18 and thus generates the most friction in the particulate media 12. Consequently, the rotational mode offers the greatest energy attenuation properties.

The flexible membrane 22 allows the blast attenuator 2 to absorb the slam-down stroke of a blast. A blast occurring below the floor of a vehicle initially blasts the chassis upwards. As described previously, the blast attenuator 2 is able to dissipate the energy of this upstroke motion through the axial movement of the stirring element 14 relative to the container 4.

When the chassis of the vehicle is instantaneously at rest at its peak height, the seat, particulate media 12 and the stirring element 14 attached to the seat continue ascending upwards due to inertia. Consequently, the particulate media 12 moves within the cavity 10 and impacts the flexible membrane 22. The flexible membrane 22 deflects under the impact of the particulate media 12, placing the flexible membrane 22 under tension. As described previously, the flexible membrane 22 has elastic properties and thus rebounds, driving the particulate media 12 downwards towards the base 8 of the container 4.

Accordingly, the particulate media 12 settles back to the bottom of the container 4 so that it is in place to absorb the slam-down stroke of the blast cycle as the stirring element 14 and the seat descend again under gravity. The flexible membrane 22 accelerates the particulate media 12 downwards faster than the rate of gravity acting alone so as to reset the blast attenuator 2 in time for the slam-down stroke.

In order to modify the friction and flow properties of the particulate media 12 in the cavity 10, the container 4 may be provided with a number of stationary protrusions 24 which project into the cavity from the outer wall 6. The purpose of the stationary protrusions 24 is to inhibit movement of the particulate media 12 at the outer wall 6. Accordingly, the stationary protrusions 24 create a boundary layer condition at the outer wall 6 where the velocity of the particulate media 12 is substantially zero. As a result of the relative smoothness of the outer wall 6, particulate-wall friction is smaller than inter-particulate friction. Therefore, the creation of this boundary layer condition using the stationary protrusions 24 maximizes the friction capacity of the blast attenuator 2.

Figure 4:
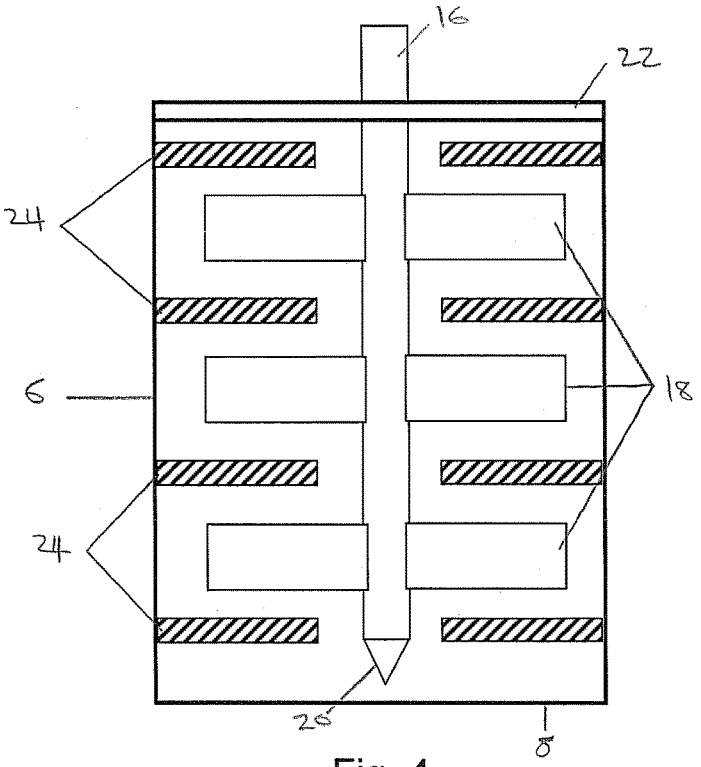
FIG. 4 is a cross-sectional view of a blast attenuator according to another embodiment of the invention.
Figure 5:
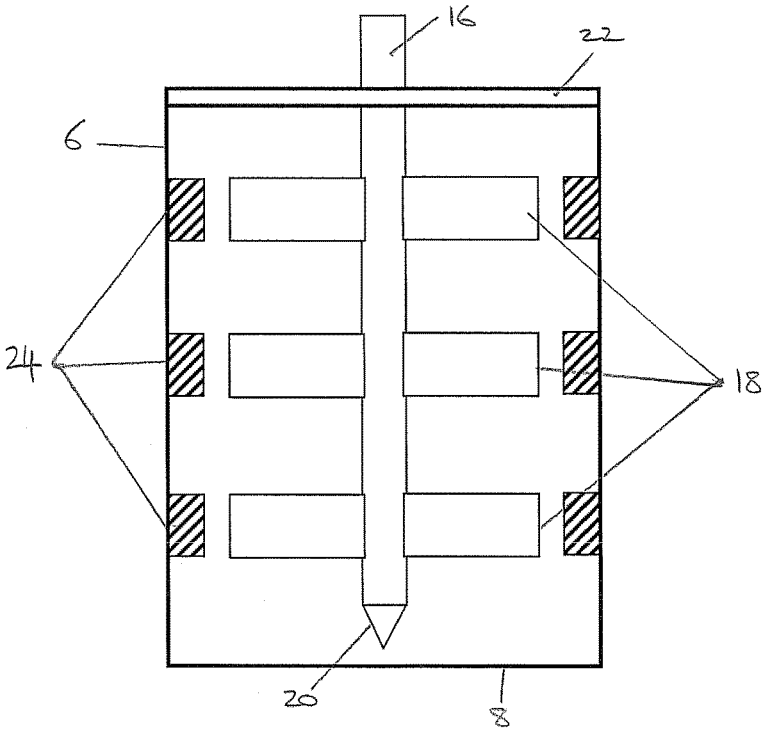
FIG. 5 is a cross-sectional view of a blast attenuator according to another embodiment of the invention.

FIGS. 4 and 5 show suitable arrangements for the stationary protrusions 24.

The stationary protrusions 24 may be flat plates which are connected at one end to the inner surface of the outer wall 6 and extend radially inwards into the cavity 10 where they terminate at a distal edge. The stationary protrusions 24 thus broadly mirror the paddles 18 of the stirring element 14. However, the stationary protrusions 24 may have different numbers and/or dimensions from the paddles 18 of the stirring element 14.

The stationary protrusions 24 are arranged about the circumference of the inner surface of the outer wall 6 to form a row. A series of rows of stationary protrusions 24 may be provided, which are spaced along the length of the outer wall 6, in a similar manner to the rows of paddles 18 described above with reference to FIG. 3.

As shown in FIG. 4, the rows of paddles 18 may be offset from the rows of stationary protrusions 24. Consequently, a row of stationary protrusions 24 may be disposed between adjacent rows of paddles 18, or vice versa. As shown, the blast attenuator 2 may comprise one more row of stationary protrusions 24 than the number of rows of paddles 18. Accordingly, each row of paddles 18 is disposed between a pair of rows of stationary protrusions 24. Alternatively, the blast attenuator 2 may comprise the same number of rows of stationary protrusions 24 and rows of paddles 18, or fewer rows of stationary protrusions 24 than rows of paddles 18.

In an alternative arrangement, as is shown in FIG. 5, each row of stationary protrusions 24 may be aligned with a corresponding row of paddles 18. The diameter of the container 4 must therefore be sized to accommodate the length of both the paddles 18 and the stationary protrusions 24.

In another alternative arrangement (not shown), there may be rows of stationary protrusions 24 which are aligned with rows of paddles 18 and there may be rows of stationary protrusions 24 which are offset from the rows of paddles 18 and thus disposed between adjacent rows of paddles 18.

Although not shown, the stationary protrusions 24 may have a profiled distal edge. For example, the distal edge may be castellated or crenellated. Alternatively, the stationary protrusions 24 may be rods which project into the cavity 10 and have a rounded end. These forms of stationary protrusions 24 impose a partial boundary layer condition which increases friction, whilst maintaining flow of the particulate media 12.

The stationary protrusions 24 may also be embodied as a series of splines which are arranged around the circumference of the inner surface of the outer wall 6, and which each run along the length of the outer wall 6 of the container 4. Such splines may run along the full length of the outer wall 6 or may be provided in discontinuous sections which are aligned and/or offset from the rows of paddles 18.

The particulate media 12 is not intended to withstand static continuous in-service loads, particularly since it will settle and shift. Accordingly, a support mechanism 26 may be provided, as is shown in FIGS. 6 and 7.

The support mechanism 26 comprises a collar 28 which is received over the shaft 16. The collar 28 is affixed to the shaft 16 by a grub-screw (not shown) or other similar means which prevents rotation of the collar 28 relative to the shaft 16. A series of spokes 30 extend radially outward from the collar toward the outer wall 6 of the container 4. The spokes 30 may be flexible strips of metal which are arranged such that deformation along the length of the strip is in the radial plane (in other words, the width of the strip is oriented axially). The spokes 30 may connect directly to the outer wall 6 of the container 4 or may be connected to a ring which is in turn connected to the outer wall 6. The spokes 30 are sufficiently stiff to absorb static in-service loads (i.e. when there is no blast), but are sufficiently flexible to yield elastically and/or plastically in order to permit large movements of the stirring element 14 relative to the container during the axial, tilting, and horizontal (lateral and longitudinal) displacements of the stirring element 14 relative to the container 4.

The spokes 30 are curved along their length. For example, the spokes 30 may have a single curve, thus resembling a C-shape, as is shown in FIG. 6 or may have a double curve, thus resembling an S-shape, as is shown in FIG. 7.

Figure 6:
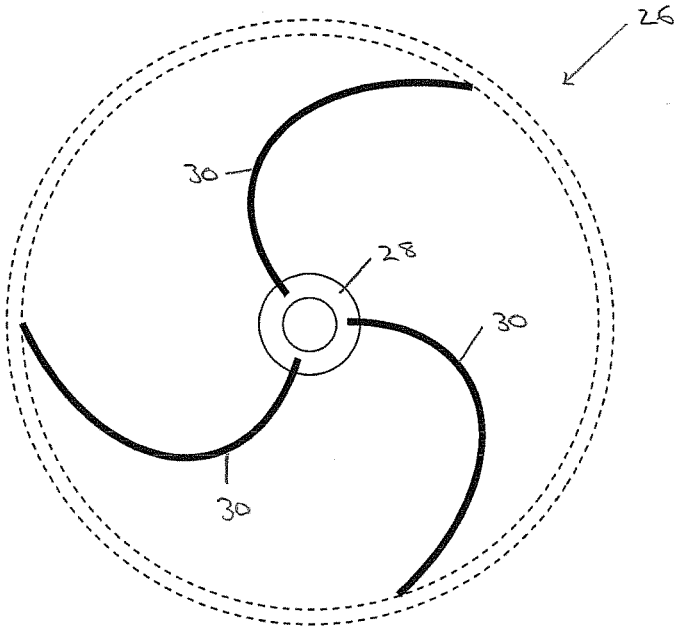
FIG. 6 is a plan view of a support mechanism which may be used in a blast attenuator.
Figure 7:
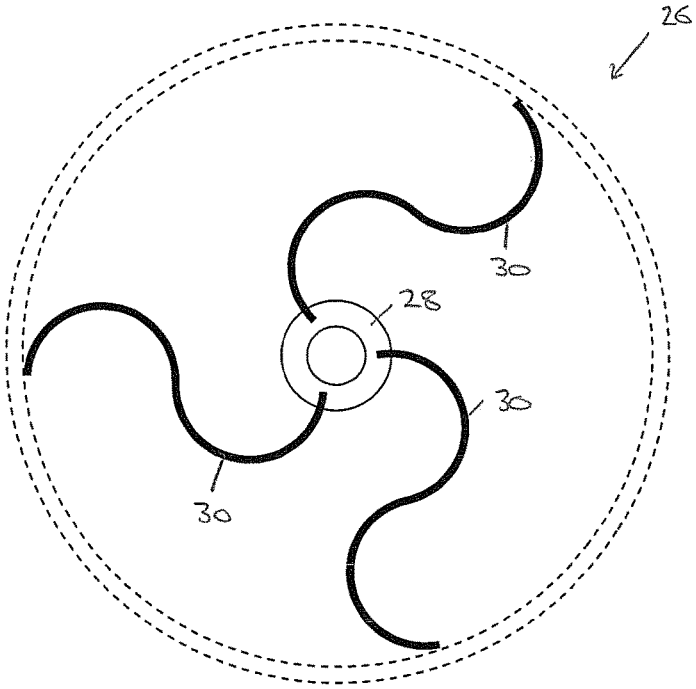
FIG. 7 is a plan view of another support mechanism which may be used in a blast attenuator.

The S-shaped spokes 30 shown in FIG. 7 are longer than the C-shaped spokes 30 shown in FIG. 6. Consequently, the S-shaped spokes 30 are more flexible in respect of in-plane and out-of-plane deflections.

The blast attenuator 2 may comprise a single support mechanism 26 or a plurality of support mechanisms provided at different positions along the length of the shaft 16. For example, a single stiff support mechanism 30 may be provided between the shaft 16 and the container 4 at the top of the outer wall 6 adjacent the flexible membrane 22.

Alternatively, a pair of support mechanisms 26 may be used; one at the top of the outer wall 6 and one at the lower end of the shaft 16 coupling the shaft 16 to the bottom of the container 4 within the particulate media 12. Where a pair of support mechanisms 26 are used, each may be less substantial than when a single support mechanism 26 is used. The pair of support mechanisms 26 produce a torque couple when there is any static tilting and thus may provide more efficient resistance to static in-service tilting tendencies while the passenger is seated.

Horizontal movement of the stirring element 14 relative to the container 4 is permitted by the lateral or longitudinal deformation of the spokes 30 in the horizontal (radial) plane. Axial movement of the stirring element 14 relative to the container 4 is allowed by the spokes 30 deforming out-of-plane under high load.

As described above, rotation of the stirring element 14 relative to the container 4 utilizes the greatest surface area of the paddles 18 and thus generates the most friction in the particulate media 12.

Consequently, the rotational mode offers the greatest energy attenuation properties.

Further, the inventor has discovered that the effective impulse or momentum dissipated by the rotation of the stirring element is constant for any granule size, particularly for sand like particles such as play sand, building sand, horticultural sand, sharp sand, etc. The specific type or size of particle has been found to only change the magnitude of the mass or load attenuated and the duration over which this occurs. For example, a sand which attenuates half the applied load of another sand does so over twice the period of time, so the product of load or mass and dissipation time, or effective impulse (momentum) is constant. For each type of media, for a given geometry of container and stirring element, the response force output by the particulate media is substantially constant since it is based upon friction alone.

Accordingly, it is desirable to provide multi-axis attenuation using the rotational mode alone.

Figure 8:
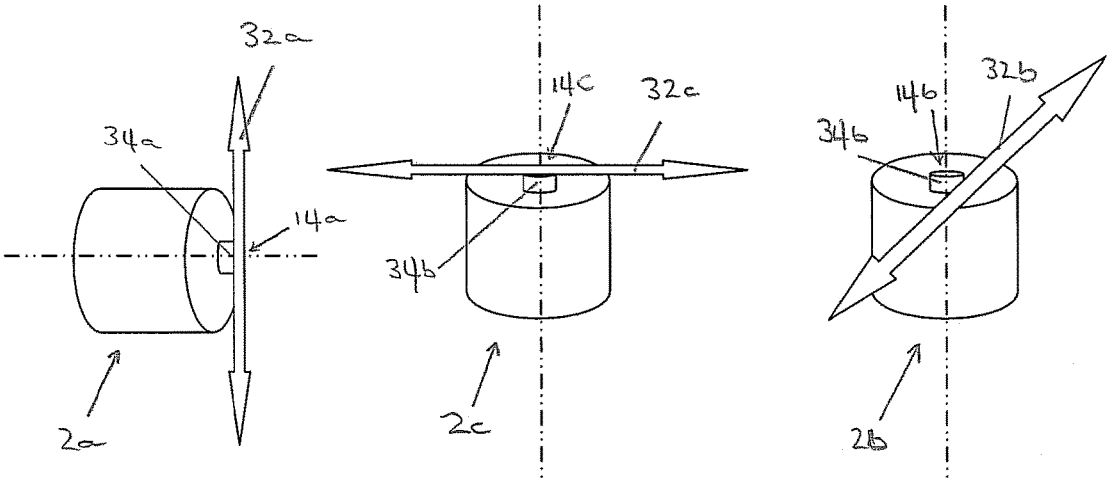
FIG. 8 is a schematic view of a blast attenuation system.

FIG. 8 shows an arrangement of blast attenuators 2 which may be used to provide attenuation along three axes using the rotational mode alone. The arrangement may form a blast attenuation system.

As shown, three blast attenuators 2*a*, 2*b*, 2*c* are used in this arrangement. Each of the blast attenuators 2*a*, 2*b*, 2*c* utilizes a rack 32*a*, 32*b*, 32*c* and pinion 34*a*, 34*b*, 34*c* mechanism to convert linear motion of, for example, the seat relative to the vehicle chassis into rotation of the stirring element 14*a*, 14*b*, 14*c*. Each of the blast attenuators 2*a*, 2*b*, 2*c* are similar to one another, however they are oriented in different directions. Further, each blast attenuator 2*a*, 2*b*, 2*c* need not be identical. For example, blast attenuator 2*a* may have a more efficient stirring element 14 having, for example, longer, wider and/or a larger number of paddles 18.

The blast attenuator 2*a* is arranged to attenuate vertical motion. Accordingly, the blast attenuator 2*a* is oriented so that the rotational axis of the stirring element 14*a* is horizontal, with the rack extending vertically. The rotational axis of the stirring element 14*a* may extend in either the lateral (left-right) or longitudinal (fore-aft) direction of the vehicle.

The blast attenuator 2*b* is arranged to attenuate lateral (left-right) motion. Accordingly, the blast attenuator 2*b* is oriented so that the rotational axis of the stirring element 14*b* is vertical, with the rack extending laterally.

The blast attenuator 2*c* is arranged to attenuate longitudinal (fore-aft) motion. Accordingly, the blast attenuator 2*c* is oriented so that the rotational axis of the stirring element 14*c* is vertical, with the rack extending longitudinally.

The rack of each of the blast attenuators 2*a*, 2*b*, 2*c* is oriented so that it is orthogonal to the other racks.

Of course, alternative arrangements of the blast attenuators 2*a*, 2*b*, 2*c* could be used to provide attenuation along three axes. For example, the rotational axes of the stirring elements 14*a*, 14*b*, 14*c* for all of the blast attenuators 2*a*, 2*b*, 2*c* may be horizontal, with two of the rotational axes being arranged laterally and the other being arranged longitudinally, or vice versa.

In combination, the blast attenuators 2*a*, 2*b*, 2*c* are able to attenuate blasts and impacts in three dimensions.

Figure 9:
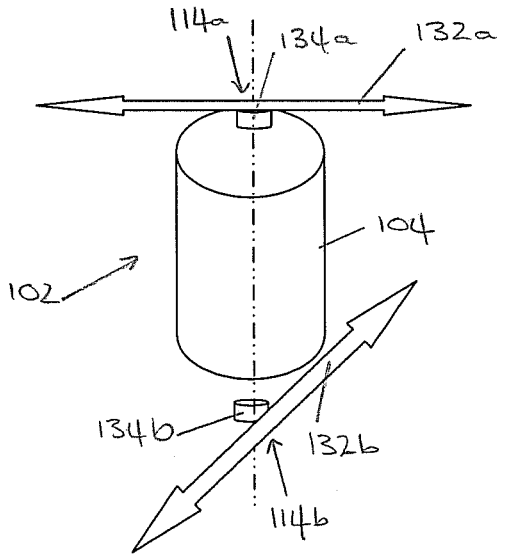
FIG. 9 is a schematic view of an embodiment of a multi-axis blast attenuator unit.
Figure 10:
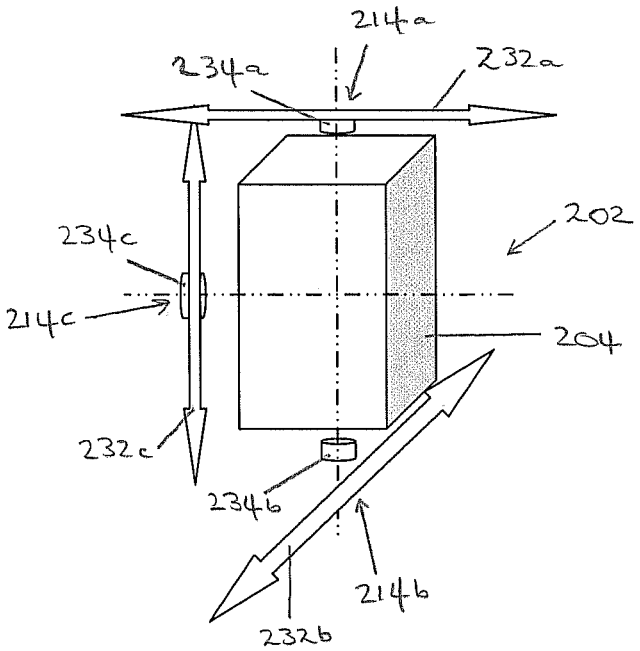
FIG. 10 is a schematic view of another embodiment of a multi-axis blast attenuator unit in a vertical configuration.
Figure 11:
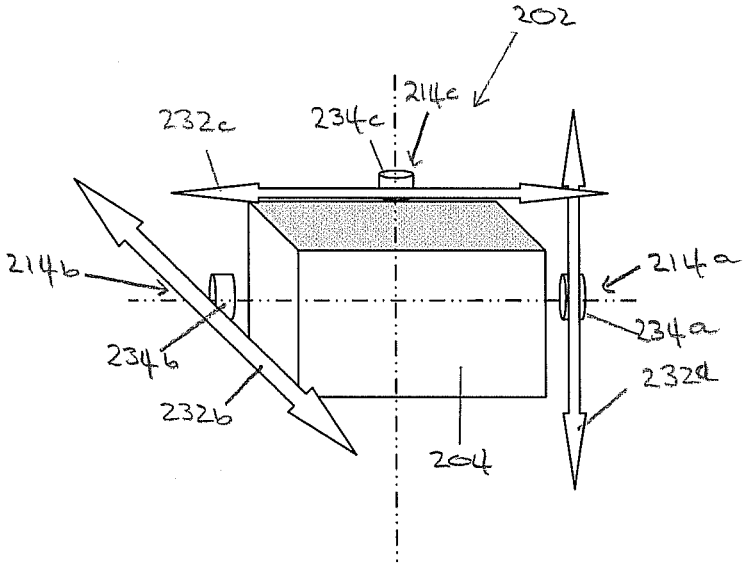
FIG. 11 is a schematic view of the multi-axis blast attenuator unit shown in FIG. 10 in a horizontal configuration.

FIGS. 9 to 11 show blast attenuators which provide multi-axis attenuation. Each of these blast attenuators comprise a plurality of stirring elements which primarily provide attenuation via the rotational mode and which utilize a common container of particulate media 12.

FIG. 9 shows a blast attenuator 102 which comprises a pair of stirring elements 114*a*, 114*b* which are independent of one another, but are used in conjunction with a common container 104.

Like the container 4, the container 104 is at least partially filled with a particulate media 12. The container 104 is similar to the container 4 described previously, however it is not necessary to provide a flexible membrane 22. The upper and lower surfaces of the container 104 may therefore be solid plates. The stirring elements 114*a*, 114*b* pass through the upper and lower surfaces of the container 104 through suitable bearings.

The container 104 is sized to accommodate both of the stirring elements 114*a*, 114*b* in a linear arrangement. One half of the container 104 is associated with the stirring element 114*a* and the other half of the container 104 is associated with the stirring element 114*b*.

Each of the stirring elements 114*a*, 114*b* utilize a rack 132*a*, 132*b* and pinion 134*a*, 134*b* mechanism to convert linear motion of, for example, the seat relative to the vehicle chassis to rotation of the stirring element 114*a*, 114*b*.

The rotational axes of the stirring elements 114*a*, 114*b* are aligned with one another. However, the racks 132*a*, 132*b* associated with each stirring element 114*a*, 144*b* are orthogonal to one another.

As shown, the rack 132*a* of the stirring element 114*a* is oriented in the longitudinal (fore-aft) direction of the vehicle, whereas the rack 132*b* of the stirring element 114*b* is oriented in the lateral (left-right) direction of the vehicle. However, the blast attenuator 102 could also be oriented so that one of the racks 132*a*, 132*b* is oriented vertically and the other is oriented in the longitudinal or lateral direction.

The blast attenuator 102 is therefore able to attenuate blasts and impacts along two orthogonal axes using a single container 104 of particulate media 12.

The blast attenuator 102 may also attenuate blasts and impacts along a third (vertical) axis using sliding bearings that allow the stirring elements 114*a*, 114*b* to move axially relative to the container 104.

As described with reference to the blast attenuator 2, the upper surface of the blast attenuator 102 may be formed as a flexible membrane to allow the blast attenuator 102 to reset itself in preparation for the slam-down stroke of the blast cycle.

With this arrangement, the stirring elements 114*a*, 114*b* are allowed to plunge into the particulate media 12 within the container 104 during an upward blast in order to attenuate the impact. The flexible membrane enables the blast attenuator 102 to reset itself in preparation for the subsequent slam-down stroke.

The flexible membrane may be omitted and instead the container 104 may be sufficiently filled with particulate media 12 so as to ensure that the stirring elements 114*a* and 114*b* are surrounded by the particles during the slam-down stroke. This may be accommodated by using a longer container 104 for the blast attenuator 102. Even where a longer container 104 is used, the blast attenuator 102 has a comparable or smaller volume compared with that of three separate single axis attenuators.

FIG. 10 shows a blast attenuator 202 which comprises three stirring elements 214*a*, 214*b*, 214*c* which are independent of one another, but are used in conjunction with a common container 204.

Like the container 4, the container 204 is at least partially filled with a particulate media 12. As shown, the container 204 is generally cuboid shaped. Having said that, other shapes may be used including a cylindrical form as used in the container 4. However, it is beneficial for the container 204 to have at least three planar surfaces which provide a convenient point of entry for the stirring elements 214*a*, 214*b*, 214*c*.

The stirring elements 214*a*, 214*b* enter the container 204 through upper and lower surfaces of the container 204, whereas the stirring element 214*c* enters the container 204 through one of the side surfaces of the container 204. The stirring element 214*c* passes through the side surface substantially at the centre of the side surface, midway between the upper and lower surfaces of the container 204.

The container 204 is sized to accommodate the stirring elements 214*a*, 214*b*, 214*c* in a linear arrangement with the stirring element 214*c* interposed in the space between the stirring elements 214*a*, 241*b*. Accordingly, assuming the stirring elements 214*a*, 214*b*, 214*c* all have the same dimensions, the height of the container should be over twice the width and depth of the container.

Each of the stirring elements 214*a*, 214*b*, 214*c* utilizes a rack 232*a*, 232*b*, 232*c* and pinion 234*a*, 234*b*, 234*c* mechanism to convert linear motion of, for example, the seat relative to the vehicle chassis into rotation of the stirring element 214*a*, 214*b*, 214*c*.

The rotational axes of the stirring elements 214*a*, 214*b* are arranged vertically and are aligned with one another. However, the racks 232*a*, 232*b* associated with each stirring element 214*a*, 214*b* are orthogonal to one another.

As shown, the rack 232*a* of the stirring element 214*a* is oriented in the longitudinal (fore-aft) direction of the vehicle, whereas the rack 232*b* of the stirring element 214*b* is oriented in the lateral (left-right) direction of the vehicle. The rotational axis of the stirring element 214*c* is horizontal and orthogonal to the rotational axes of the stirring elements 214*a*, 214*b*. Similarly, the rack 232*c* of the stirring element 214*c* is orthogonal to the racks 232*a*, 232*b* of the stirring elements 214*a*, 214*b*. The rack 232*c* of the stirring element 214*c* is oriented in the vertical direction.

The blast attenuator 202 is therefore able to attenuate blasts and impacts along three orthogonal axes using a single container 204 of particulate media 12.

As described with reference to the blast attenuator 2, the upper surface of the blast attenuator 202 may be formed as a flexible membrane to allow the blast attenuator 2 to reset itself in preparation for the slam-down stroke of the blast cycle. However, the container 204 may be sufficiently filled with particulate media 12 so as to ensure that the stirring element 214*c* is surrounded by the particles during the slam-down stroke. Providing the stirring element 214*c* midway between the upper and lower surfaces ensures that the stirring element 214*c* is surrounded by the particles at all times.

The blast attenuator 202 may be used in a vertical configuration, as was described previously and shown in FIG. 10, or may be used in a horizontal configuration as shown in FIG. 11.

In the horizontal configuration, the stirring element 214*c* enters the container 204 through what is now the top surface of the container 204, and the stirring elements 214*a*, 214*b* enter the container 204 through side surfaces of the container 204.

With this arrangement, the rotational axes of the stirring elements 214*a*, 214*b* are arranged horizontally and the rotational axis of the stirring element 214*c* is arranged vertically.

The rack 232*a* of the stirring element 214*a* is oriented in the lateral (left-right) direction of the vehicle, the rack 232*b* of the stirring element 214*b* is oriented in the vertical direction, and the rack 232*c* of the stirring element 214*c* is oriented in the longitudinal (fore-aft) direction of the vehicle.

If a flexible membrane is used, again this is provided on the surface of the blast attenuator 202 which is the upper surface in the horizontal configuration.

The blast attenuator 202 may be used in either the vertical or horizontal configuration depending on the space constraints of the application.

With each of the blast attenuators described above in relation to FIGS. 8 to 11, the stirring elements only need rotational freedom and do not need to translate and move axially relative to the container. Each of the stirring elements can therefore be rotatably coupled to the container using a bearing which is suitable for use with the particulate media 12. Such a bearing can withstand the static continuous in-service loads and thus it is not necessary to use a support mechanism 30 with these arrangements. Nevertheless, the stirring elements may be allowed to move axially relative to the container to provide additional damping and/or flexibility in the coupling of the blast attenuator to the respective components. As described, a flexible membrane may be provided above the particles to allow the blast attenuator to reset itself.

The size of the pinion gear need not be the same for each of the stirring elements. The size of the pinion can thus be varied in order to rotate the stirring elements at different rates which are optimised for each axis of attenuation in order to provide the desired attenuating force.

The pinion of at least the stirring element responsible for attenuating vertical motion may be coupled to the stirring element via a ratchet mechanism, or other similar mechanism. The ratchet mechanism is configured so as to be in an engaged configuration when the rack moves downwards relative to the pinion and to be in a disengaged configuration when the rack moves upwards relative to the pinion.

The rack moves downwards relative to the pinion during both the initial upwards stroke of the blast and the subsequent slam-down stroke of the blast. Accordingly, the ratchet mechanism is in the engaged configuration and thus attenuates the blast by converting rotation of the pinion into rotation of the stirring element against the resistance of the particulate media 12.

On the other hand, the rack moves upwards relative to the pinion just prior to the slam-down stroke as the rack rebounds upwards. Accordingly, the ratchet mechanism is in the disengaged configuration and thus allows the pinion to rotate without rotating the stirring element. Therefore, the pinion can move relative to the rack without any resistance from the particulate media 12. The position of the rack and pinion can thus be reset (or returned towards the reset position) prior to the slam-down stroke.

The axes of the stirring elements may be offset from one another so as to provide flexibility in the dimensions of the container.

The cuboid shape of the containers 104, 204 impose a boundary layer condition near the edges of the container. Here the particulate media 12 stagnates or reverses its flow direction such that the velocity of the particulate media 12 is substantially zero. Accordingly, with this container geometry it may be possible to avoid using any stationary protrusions or to reduce the number of protrusions.

Although the stationary protrusions 24 have been described as extending from the outer wall 6 of the container 4, they may be provided as a separate component which is stationary relative to the container 4, but which may or may not be in direct contact with the outer wall 6. Further, stationary protrusions 24 may also be provided along the base 8 of the container 4.

In an alternative embodiment, not illustrated, the stirring element may comprise a helical stirrer or a formed wire stirrer instead of the paddles 18. Such stirrers interact with the particulate media 12 in a similar manner to create resistance against the movement of the stirring element relative to the container. Again, a plurality of such stirrers may be spaced along the length of the shaft 16, with the stationary protrusions 24 therebetween.

Although the paddles 18 have been described as being flat plates, they may be curved along their radial length and/or axial width. Further, although it may be beneficial to use an even number of paddles 18, this is not essential. Likewise, the paddles 18 need not be equiangularly spaced about the circumference of the shaft 16.

The paddles 18 have been described herein as being aligned with the longitudinal axis of the shaft 16. However, the paddles 18 may in fact be angled with respect to the longitudinal axis of the shaft 18. Such angling of the paddles 18 may increase resistance to axial movement of the stirring element, where this is permitted. Further, the angling of the paddles 18 may cause the stirring element to rotate in response to axial movement of the stirring element through the particulate media 12.

A rack and pinion mechanism has been described for converting linear motion into rotary motion of the stirring element. It should be appreciated that other mechanisms could also be used for this purpose. Further, more complex gearing mechanisms may be used to convert linear motion along more than one axis into rotary motion of a single stirring element.

As described previously, the particulate media may comprise granules, fibres and/or flakes of a suitable material.

For example, where granules are used, the media may be sand, grinding grit, dry silt, polymer particles, dust such as graphite or Fuller's earth, or a mixture.

A pure very fine sand or dust gives the lowest friction and best possible flow to alleviate local lock-up (jamming) spots caused by any excessive friction, whereas a pure large size grainy gravel gives very high friction resistance and limits such alleviating flow.

Where fibres fibers are used, the media may be chopped glass fiber such as E glass, S glass or re-melted basalt; or chopped polymer fibre such as nylon, polyester or aramid; or chopped metallic fiber such as brass, bronze, iron or stainless steel.

The media may be of any fiber length or combination thereof, chosen to optimize the frictional and flow properties of the media. A higher ratio of length to width (i.e. a higher aspect ratio) will raise the friction and reduce the alleviating flow permitted within the media, both of which increase the resistance of the media to motion by the stirring element. Glass, ceramic and metal based fibers give the highest friction while offering the least amount of flow, whereas polymer fibers reduce the friction and simultaneously permit increased flow.

Where flakes are used, the ratios of both surface area to thickness and length to width (aspect ratio) may be adjusted to optimize friction and flow properties. The material may be flint flakes (waste from the stonemasonry crafting and tiling industry), mica mineral (from the electronics or paints industries) or other lamellar geological ceramic ore deposits (from the jewelry or interior decoration industries). Alternatively, the flakes may be specifically manufactured flakes.

Although the invention has been described with reference to applications in relation to the seat of a vehicle, it may be used for other purposes. For example, one or more blast attenuators may be provided between the chassis of a vehicle and a movable hull (such as a V-hull) which can move relative to the chassis in the event of a blast. Other applications may also be envisaged.

The blast attenuators described herein are able to dissipate the energy, momentum (impulse), forces, and/or velocity resulting from a blast. Accordingly, references to attenuation should be construed broadly to encompass all applicable modes by which the deleterious effects of a blast can be reduced. The attenuation of the blast ultimately results in the generation of heat within the particulate media.

The foregoing information broadly describes the present invention without limitation. Variations and modifications as will be readily apparent to those skilled in the art are intended to be included within the scope of the invention as defined by the appended claims.

The invention claimed is:

1. A blast attenuator comprising:

a container having an outer wall, the outer wall defining a cavity in which a particulate media is disposed; and a stirring element disposed in the container and movable relative to the container, at least a portion of the stirring element extending into the particulate media, wherein, in use, the particulate media provides resistance against movement of the stirring element relative to particulate media so as to attenuate the energy of a blast.

2. The blast attenuator of claim 1, further comprising a plurality of stationary elements which project into the cavity and which are fixed relative to the container.

3. The blast attenuator of claim 2, wherein the stationary elements are arranged around an inner perimeter of the container to form one or more rows.

4. The blast attenuator of claim 2, wherein the stationary elements comprise plates.

5. The blast attenuator of claim 1, wherein the stirring element comprises a shaft and a plurality of paddles which extend radially from the shaft into the particulate media.

6. The blast attenuator of claim 5, wherein the paddles are aligned with a longitudinal axis of the shaft and extend radially from the shaft.

7. The blast attenuator of claim 5, wherein the paddles are spaced equiangularly about the shaft.

8. The blast attenuator of claim 5, wherein the paddles are arranged around the perimeter of the shaft to form one or more rows.

9. The blast attenuator of claim 8, wherein the paddles are flat plates.

10. The blast attenuator of claim 1, wherein the stirring element comprises a helical stirrer or a formed wire stirrer.

11. The blast attenuator of claim 1, further comprising a support mechanism which movably couples the stirring element to the container.

12. The blast attenuator of claim 11, wherein the support mechanism comprises a plurality of spokes which connect the stirring element to the container and which are deformable along their length to allow the stirring element to move relative to the container.

13. The blast attenuator of claim 12, wherein the spokes are C-shaped or are S-shaped.

14. The blast attenuator of claim 11, further comprising a second support mechanism which movably couples the stirring element to the container, the first and second support mechanisms being provided at different positions along the axial length of the stirring element.

15. The blast attenuator of claim 1, further comprising a flexible membrane which encloses the cavity and retains the particulate media.

16. The blast attenuator of claim 1, wherein the stirring element is rotatably coupled to the container.

17. The blast attenuator of claim 1, wherein a plurality of stirring elements are disposed in the container and configured to attenuate the energy of a blast along a plurality of different axes that are orthogonal to one another.

18. The blast attenuator of claim 17, wherein the blast attenuator comprises three stirring elements.

19. The blast attenuator of claim 1, wherein the stirring element is associated with a mechanism for converting linear motion into rotary motion of the stirring element.

20. The blast attenuator of claim 19, wherein the mechanism is a rack and pinion, the pinion being coupled to the stirring element to rotate the stirring element in response to linear motion of the rack relative to the pinion.

21. The blast attenuator of claim 20, wherein the pinion is coupled to the stirring element via a ratchet mechanism, the ratchet mechanism having an engaged configuration which prevents relative motion between the stirring element and the pinion and a disengaged configuration which allows relative motion between the stirring element and the pinion.

22. A blast attenuator comprising:

a container having an outer wall, the outer wall defining a cavity in which a particulate media is disposed; and a stirring element comprising a shaft and a plurality of paddles which extend radially from the shaft into the particulate media, wherein, in use, the particulate media provides resistance against movement of the stirring element relative to particulate media so as to attenuate the energy of a blast.

23. The blast attenuator of claim 22, further comprising a plurality of stationary elements which project into the cavity and which are fixed relative to the container.

24. The blast attenuator of claim 23, wherein the stationary elements are arranged around an inner perimeter of the container to form one or more rows which are spaced from one another in an axial direction, and the paddles are arranged on the shaft in one or more rows which are spaced from one another in an axial direction.

25. The blast attenuator of claim 24, wherein each of the one or more rows of paddles is aligned with one of the one or more rows of stationary elements.

26. The blast attenuator of claim 24, wherein each of the one or more rows of paddles is offset from each of the one or more rows of stationary elements.

27. A blast attenuating vehicle seating system, comprising:

a linearly moveable seat;

a container having a cavity in which a particulate media is disposed;

a stirring element disposed in the container and movable relative to the container, at least a portion of the stirring element extending into the particulate media; and a mechanism for converting linear motion of the seat into motion of the stirring element within the container.

28. The blast attenuating vehicle seating system of claim 27, wherein the stirring element comprises a shaft and a plurality of paddles that extend radially from the shaft into the particulate media, and the mechanism for converting linear motion of the seat into motion of the stirring element within the container is configured for converting linear motion of the seat into rotary motion of the stirring element.

29. The blast attenuating vehicle seating system of claim 28, further comprising a plurality of stationary elements which project into the cavity and which are fixed relative to the container.

30. The blast attenuating vehicle seating system of claim 27, wherein the mechanism for converting linear motion of the seat into motion of the stirring element within the container comprises a rack gear coupled to the seat, and a pinion gear coupled to the stirring element.

* * * * *